United States Patent [19]

Parise et al.

[11] 4,316,304

[45] Feb. 23, 1982

[54] DOUBLE DISCONNECT, WATERPROOF ELECTRICAL CONNECTOR ASSEMBLY FOR ELECTRIFIED VACUUM HOSE FOR WET/DRY VACUUM CLEANER

[75] Inventors: Carl Parise; Rainer R. Schulz, both of Reno, Nev.

[73] Assignee: Parise & Sons, Inc., Sparks, Nev.

[21] Appl. No.: 183,798

[22] Filed: Sep. 4, 1980

[51] Int. Cl.[3] ..... A47L 9/28

[52] U.S. Cl. ..... 15/339; 15/377; 200/51.09; 200/302

[58] Field of Search ..... 15/321, 377, 339; 200/51.09, 302

[56] References Cited

U.S. PATENT DOCUMENTS

| | | | |
|---|---|---|---|
| 2,466,370 | 4/1949 | Burtt | 339/45 M |
| 2,532,538 | 12/1950 | Burtt et al. | 339/45 M |
| 2,735,906 | 2/1956 | Avrunin | 200/51.09 |
| 2,736,870 | 2/1956 | De Jur et al. | 339/45 M |
| 2,879,495 | 3/1959 | Ingram | 339/45 M |
| 2,890,264 | 6/1959 | Duff | 174/47 |
| 3,043,925 | 7/1962 | Wilson | 200/51 R |
| 3,100,907 | 8/1963 | Schwertl | 15/377 |
| 3,210,715 | 10/1965 | Mitchell et al. | 339/16 R |
| 3,598,941 | 8/1971 | Nelson | 200/51.09 |
| 3,848,291 | 11/1974 | Morse | 15/321 X |
| 3,928,715 | 12/1975 | Hodden | 174/47 |
| 3,965,526 | 6/1976 | Doubleday | 15/377 |
| 3,982,084 | 9/1976 | Cooperstein | 200/51.09 |
| 4,046,989 | 9/1977 | Parise et al. | 219/437 |
| 4,283,594 | 8/1981 | Somers | 15/377 X |

*Primary Examiner*—Chris K. Moore

*Attorney, Agent, or Firm*—Sughrue, Mion, Zinn, Macpeak & Seas

[57] ABSTRACT

A cylindrical molded plastic cuff at one end of a double flexible tube electrified vacuum hose for a wet/dry vacuum cleaner includes an integral molded plastic pocket bearing an elongated receptacle body of insulation material. The body includes two laterally spaced bores, counterbored from one end, which counterbores bear enlarged peripheral recesses intermediate of their ends. Cylindrical plungers sized to the counterbores and having a radially enlarged collar intermediate of their ends, in excess of the diameter of the counterbore but less than the peripheral recess, are slidably mounted therein with the collar positioned in the radial recess. A coil spring sized to the peripheral recess is compressed between the collar and one end of the radial recess to spring bias the plunger away from the bore. An O-ring seal whose outside diameter is approximately equal to that of the radial recess is positioned on the plunger to the side of the collar opposite that of the coil spring. The end of the plunger facing the bore carries a reduced diameter portion acting as a male contact which slidably fits into a small diameter axial hole within the facing end of a female contact having a base portion sealably carried within the bore of the receptacle body. A plug bears male contact prongs which project into female contacts formed within the end of the plunger opposite the compression spring. The plug locks to the cuff when the plug male contact prongs mate with the female contacts of the plungers, and the plungers are forciably displaced against the bias of the springs to engage their male contact ends with the axial holes within the fixed female contacts to complete a two part electrical connection through the plug and between the electric motor driving a scrubber mechanism of a vacuum cleaner vacuum pick up head and an electrical source at the opposite end of the hose.

3 Claims, 6 Drawing Figures

DOUBLE DISCONNECT, WATERPROOF ELECTRICAL CONNECTOR ASSEMBLY FOR ELECTRIFIED VACUUM HOSE FOR WET/DRY VACUUM CLEANER

FIELD OF THE INVENTION

This invention relates to hot water vacuum extraction machines, and more particularly to an improved electrified vacuum hose assembly for wet pick up and return of the dirty water from the surface being cleaned to a dirty water accumulation tank to which the vacuum pickup head is attached by way of the vacuum hose.

BACKGROUND OF THE INVENTION

In recent years, hot water vacuum extraction machines have come into vogue for permitting the housewife to clean rugs and floor surfaces by spraying a very hot water onto the surface by means of a spray nozzle fixed to a vacuum pick up head. The resulting dirty water is returned to a dirty water accumulation tank borne by the machine remote from the head and connected thereto by a suction hose leading from the tank to the vacuum head. In an effort to improve the cleaning action at the point of liquid spray application, such vacuum heads have employed electric motors driving a rotating brush or scrubber to aid in loosening of the dirt. Whether the surface being cleaned is a rug, or a solid flooring, removal of the dirt is effected by entraining the water within the air stream flowing through the connecting vacuum hose under vacuum pressure exerted at the dirty water accumulation tank.

Not only are there requirements to feed alternating current voltage to the electric drive motor for the scrubber, but due to the vacuum removal of dirty water through the vacuum hose, the electrical wires borne by the hose assembly must be maintained isolated from the water returning to the tank. Otherwise, the water will short the electrical wires with resulting damage to the assembly, if not to the scrubber drive motor. In addition, it must be appreciated that in the utilization of the hot water vacuum extraction machines, such vacuum hose assemblies are subjected to considerable mechanical abuse, the hoses are dragged over the surface being cleaned, they contact objects of furniture during cleaning, and they may be stepped on. This may not only impair their ability to carry the water during the vacuum return to the dirty water accumulation tank, but mechanical damage to the insulation surrounding the electrical wires, may, regardless of their possible contact with water, lead to shorting between the adjacent wires.

Such vacuum hose assemblies may be formed in a single or double concentric tube arrangement, with the tubes corrugated, tending to make them not only flexible but also permitting some expansion and contraction of the hose assembly. Due to the utilization of tubular couplings at respective ends of the hose assembly for coupling the hose assembly to the vacuum head at one end, and to the dirty water accumulation tank at the opposite end, electrical connection means must be attached to the lead wires. Male and female connectors electrically connect the leads borne by the hose assembly to the motor leads at the scrubber end of the vacuum hose and to the electrical supply means at the machine end. Where the hose assembly functions to return dirty water, means must be provided for prevention of any water from getting to the leads. Conventional single break connection and disconnection of the electrical leaks have in the past failed to insure against this possibility.

It is, therefore, a primary object of the present invention to provide an improved electrified vacuum hose for a wet pick up machine, in which electrical disconnection of the electrical wires leading from the machine proper to the scrubber motor of the pickup vacuum head, is assured, and wherein positive sealing of the electrical disconnect contacts is assured regardless of whether the electrical receptacle borne by the hose is in contact open or contact closed condition.

SUMMARY OF THE INVENTION

The present invention is directed to an improved electrified wet pick up vacuum hose assembly for a wet dry vacuum extraction machine, and specifically, for vacuum coupling of a vacuum pickup head to a dirty water accumulation tank, and wherein the vacuum head includes an electrically motor driven scrubbing assembly. The hose assembly is comprised of tubular couplings at opposite ends, and comprise concentric, inner and outer flexible tubes or hoses bearing at opposite ends, respectively tubular couplings. Electrical wires are carried between the flexible tubes for connecting an electrical source at the water accumulation tank end of the hose to the electrical motor at the vacuum head end. The invention is particularly directed to a plug and receptacle connection assembly borne by the vacuum hose assembly at the vacuum head end thereof. The vacuum hose assembly comprises a cylindrical cuff bearing a pocket which mounts an elongated receptacle body to which is detachably coupled a plug having male contact prongs for insertion within receptacle body bores. The improvement resides in means forming a positive acting, double disconnect between the ends of the electrical leads leading to the receptacle and the male contacts of the plug.

Preferably the receptacle body is formed of a molded insulative material bearing laterally spaced bores, from one end of the body. The bores are counterbored and the counterbores bear circumferential or peripheral recesses along a portion of their length. An elongated cylindrical plunger is slidably mounted within each counterbore and includes a radial collar intermediate of its ends having a diameter on the order of the diameter of the recess. A coil spring is mounted within the recess to one side of the collar and an O-ring seal is mounted to the opposite side. The compression spring acts to normally shift the plunger axially such that a male contact end is spaced from a female contact end of a fixed first contact extending through the bore and being held therein and being connected to an electrical lead wire borne between the vacuum hose. The plunger terminates on the side opposite coil spring in a female contact which includes an axial bore for receiving the tip of a male contact prong portion borne by the plug. The plungers form second contacts and the plug prongs form third contacts for the connection assembly. Locking means borne by the rigid cuff envelopes the periphery of the electrical lead wire bearing the plug and abut a radially enlarged portion of the plug to lock the plug to the cuff with its male contact prongs projecting into the counterbores and within the plunger female contact axial bores. This axially depresses the plungers against the bias of the springs to the extent where engagement occurs between the male contact ends of the plungers and the axial bores within the female fixed contacts to the receptacle to complete a two break electrical connection between the plug and the wires of the vacuum hose, at that end of the hose assembly. The collar on the plunger functions along with one shoulder formed by the peripheral recess to insure sealing by the O-ring seal of the first and second contacts, interior of the receptacle, regardless of whether the plunger is in closed contact or open contact position.

DESCRIPTION OF THE PREFERRED EMBODIMENT

Figure 1:
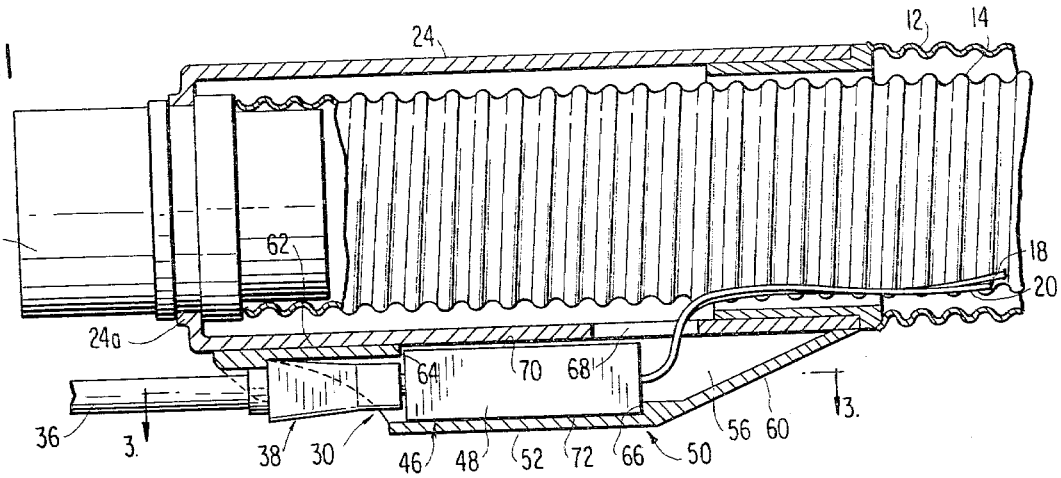
FIG. 1 is a vertical sectional view, partially broken away, of one end of an electrified vacuum hose assembly for wet pick up and employing the double disconnect waterproof electrical connector assembly, forming a preferred embodiment of the present invention.

FIG. 1 shows one end of an electrified vacuum hose assembly 10 for wet pick up, forming one embodiment of the present invention. The hose assembly 10 is preferably part of a hot water vacuum extraction machine and forms a component thereof, functioning to make a vacuum connection between a dirty water accumulation tank (not shown) at the machine proper and a vacuum head (not shown) remote from the machine and connected to the machine via the hose assembly 10. In addition to forming a vacuum passage permitting return of dirty water after cleaning to the accumulation tank within the machine proper, the hose assembly 10 functions to permit electrical current to be supplied to an electric motor (not shown) at the vacuum head and functioning to drive a scrubber assembly (not shown) for scrubbing the surface being cleaned at the point of vacuum application.

The hose assembly 10 comprises concentric corrugated flexible or tubular hoses including an outer hose 12 and an inner hose 14 which are spaced somewhat to form an annular gap 16 therebetween. Within this gap are longitudinally borne, a pair of electrical leads or insulated wires 18 and 20 which extend generally the length of the hose assembly 10 and which require some type of electrical connector assembly at opposite ends of the hose assembly. Normally, conventional single break point connection male and female coupling means such as a male prong connector plug and a female connector receptacle bearing appropriate female type contacts make the electrical connections to wires borne by this type of hose assembly.

In order to effectively form a disconnectable tube coupling between the vacuum head and the hose assembly 10, there is required a rigid plastic tubular coupling indicated generally at 22 and to which the concentric hoses 12 and 14 must be coupled. In that regard, the inner small diameter flexible hose 14 is mounted directly to the coupling 22 with an end 14*a* in abutment with a radially enlarged collar 22*a* borne by that coupling. The end 14*a* of the inner hose 14 may be adhesively fixed to the periphery of the coupling tube 22, about reduced diameter portion 22*b*. Alternatively, some type of mechanical clamp may be employed to insure an air seal connection between hose 14 and coupling 22.

In addition to collar 22*a*, a second collar 22*c* is integrally provided to the coupling 22 forming a peripheral recess or gap 22*d* therebetween. Mounted within the gap 22*d* is an annular portion or flange 24*a* of a rigid plastic cylindrical cuff indicated generally at 24, the cuff having a diameter in excess of the inner flexible tube or hose 14 and having an outer diameter on the order of that of outer hose or flexible tube 12. The end 16*a* of the outer hose 16 is rigidly coupled by adhesive, welding or the like, to a mounting ring 26. Ring 26 bears a peripheral recess 28 within its outer periphery, the diameter of the ring 26, at recess 28, being generally equal to the inner diameter of cuff 24 with one end of the cuff being received therein and being rigidly coupled thereto by way of adhesive or the like. Thus, the ends of the inner and outer hoses 12 and 14 are sealably mounted to the coupling 22 and to cuff 24, respectively, the flange 24*a* permitting the cuff to rotate relative to coupling 22 independent of the inner hose 14.

Figure 2:
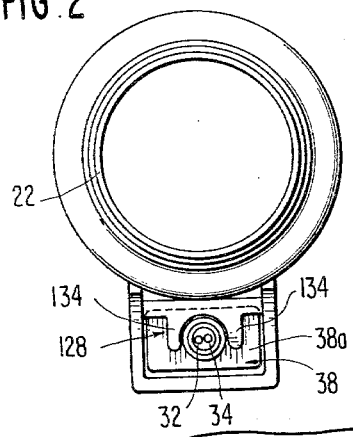
FIG. 2 is an end view of the vacuum hose assembly illustrated in FIG. 1.

The present invention is directed to an electrical connector assembly indicated generally at 30 borne by the cuff 24 and wherein a waterproof double break electrical disconnect is effected between the wires or leads 18 and 20 leaking from the vacuum hose, and a pair of corresponding electrical leads indicated generally at 32 and 34, FIG. 2, which are electrically insulated from each other and borne by an insulated conductor assembly 36, which terminates in a male plug indicated generally at 38. The male plug includes a pair of laterally spaced male contact prongs as at 40 and 42. The plug 38 is comprised of a plug body 44 formed of molded plastic, rubber or other insulative material which bears the male contact prongs 40 and 42, and wherein internally the prongs are connected electrically to lead wires 32 and 34 borne by insulated conductor assembly 36.

The electrical connector assembly 30, in addition to plug 38, is comprised of an electrical receptacle indicated generally at 46, including a receptacle body 48 of generally elongated rectangular form, being formed of an insulation material such as molded plastic, rubber or the like, and being specially mounted to cuff 24. In that respect, the cuff carries a connector assembly housing, indicated generally at 50, which may be integrally molded with cuff 24 or may be separately molded and adhesively affixed to the periphery of cuff 24. Housing 50 is generally U-shaped in transverse cross-section including a bottom wall 52, FIG. 3, and opposed sidewalls 54, defining an elongated generally rectangular cavity or pocket 56. The front of the housing 50 includes an opening 58, that is, it is open at the end proximate to the coupling 22 and is closed off at end 80 remote from the coupling tube 22, by a tapered end wall 60. Further, the housing 50 includes a base portion or upper wall 62 terminating in an end wall or shoulder 64 just rearward of opening 58. Correspondingly, bottom wall 52 includes a transverse shoulder 66 diagonally opposite shoulder 64, the shoulders functioning as stops for the inserted receptacle body 48 and being sized to the length of that body so as to snugly receive the receptacle body 48 when the receptacle body 48 is inserted within opening 58 into pocket 56, during assembly of the connector components.

The cylindrical cuff 24 is provided with an elongated slot or opening 68 which opens to cavity 56 of the housing 50 through which the electrical leads or wires 18, 20 project for electrical connection to appropriate contacts borne by the receptacle body 48.

The receptacle body 48 is, as indicated previously, of rectangular form having a top 70, a bottom 72, opposite sides 74 and 76, and a front end 78 and a rear end 80. The rear end 80 of body 48 abuts shoulder 66 when the upper edge of body front end 78 abuts the shoulder or end 64 of base 62, after body insertion within the cavity 56 formed by housing 50. A rectangular opening or hole 82 is formed within the rear end 80 of the receptacle body. The hole 82 extends laterally almost the full width of the receptacle body. Further, the body is provided with parallel, side by side, transversely aligned, bores as at 84, 86. Bore 84 is enlarged by a counterbore 88, bore 86 includes counterbore 90 to the side of bore 88 opposite that of hole 82. The counterbore 88 extends completely to the front end 78 of the receptacle body 48. The counterbore 88 includes an enlarged peripheral recess 92, between the ends of the counterbore, forming shoulders 94 and 96. Likewise, the counterbore 90 is provided with a peripheral recess 98 defining axially spaced shoulders 100 and 102, at opposite ends of this recess within counterbore 90.

Figure 3:
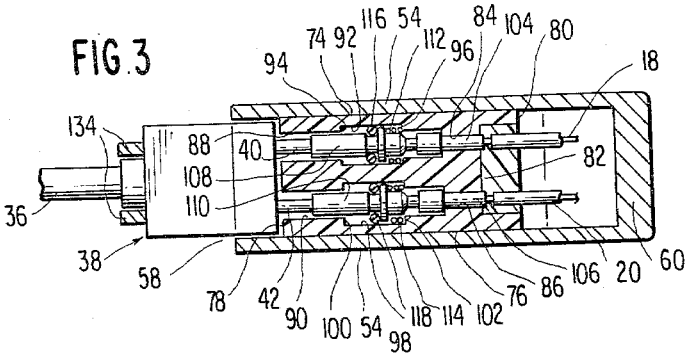
FIG. 3 is a longitudinal sectional view of the electrical connector assembly taken about line 3—3 of FIG. 1.

As seen in FIG. 3, bore 84 carries a female contact member indicated generally at 104, a counterpart female contact member 106 being provided within counterbore 88. Cooperating with the female contact members 104, 106 are resectively a solid cylindrical metal conductive plunger 108 within counterbore 88, and a similar plunger 110 within counterbore 90. The plungers are spring biased towards contact open position by means of coil springs 112, 114 respectively. Additionally, within the peripheral recesses 92, 98, there are provided O-ring seals 116, 118 respectively for these plungers.

Figure 4A:
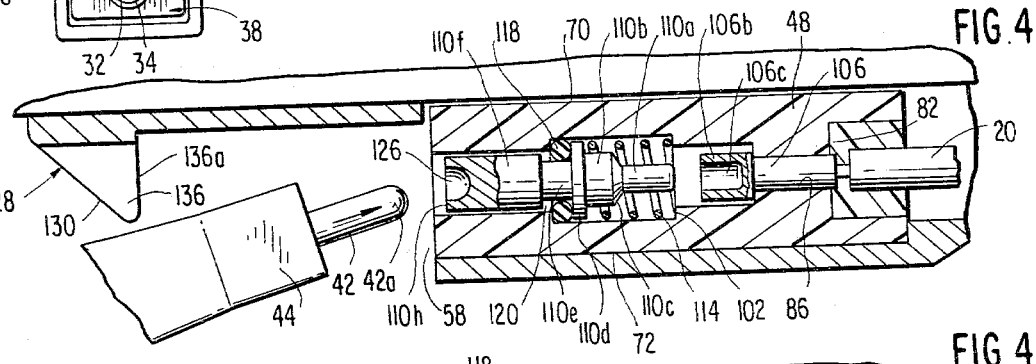
FIGS. 4*a*–4*c* inclusive are enlarged, sectional views showing the sequence of making the electrical connection between the plug and receptacle elements of the electrical connector assembly of the present invention.
Figure 4B:
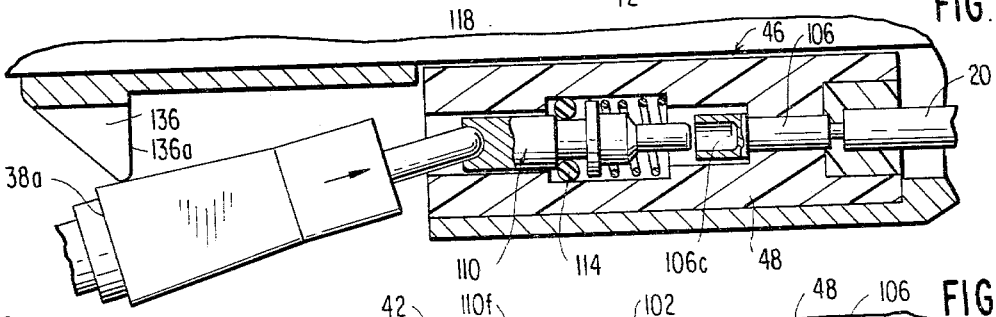
Figure 4C:
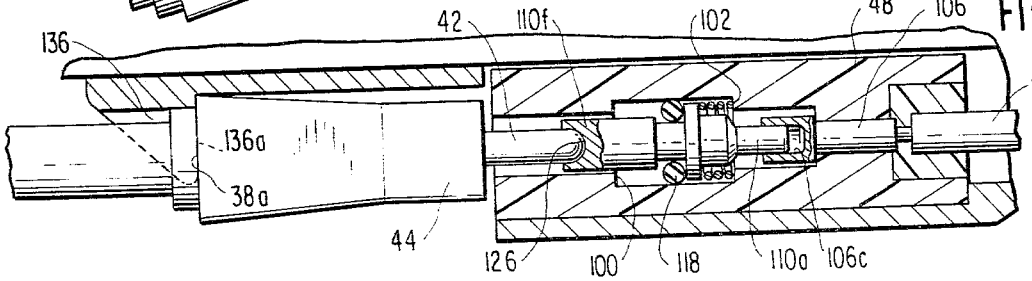

Referring to FIGS. 4A–4C, the make up of one-half of the electrical connector assembly may be readily appreciated particularly in view of the enlargement in scale of the elements illustrated therein. The female contact member 106, forming a first contact of a series of three contacts for the connector assembly half, makes one of the double break disconnect by contact with spring biased plunger indicated generally at 110. Plunger 110 forms a second contact. The plunger in turn makes electrical contact with the male prong 40 of plug 38. The prong 40 forms a third contact for the connection process. In order to effect the electrical connection between lead wire 20 carried by the vacuum hose and the female contact member 106, the electrical insulation of the lead wire 20 is stripped back exposing the bare wire conductor 20*a* which is preferably braized directly to the female contact member 106 after the end of the conductor 20*a* is inserted within an axially extending hole (not shown) within the center of the small diameter portion 106*a* of the female contact member 106. Further, the female contact member 106 includes a second enlarged diameter portion 106*b*, thereby forming a shoulder on that contact member which abuts the end of counterbore 90 meeting bore 86. The enlarged diameter portion 106*b* carries an axial hole or bore 106*c* which slidably receives a reduced diameter male contact or end 110*a* of plunger 110 and being sized so as to form a tight but sliding fit when the plunger 110 is projected to the right, against the bias of coil spring 114. The coil spring 114 is sized such that one end abuts shoulder 102 of the peripheral recess 98 within the counterbore 90. Plunger 110, in addition to the reduced diameter portion 110*a*, includes a portion 110*b* of a diameter less than that of peripheral recess 98, which portion 110*b* joins the male contact 110*a* of the plunger by an oblique or tapered plunger portion 110*c*. The plunger 110 is further provided with a radial enlargement or collar 110*d* of a diameter in excess of that of plunger portion 110*b* but less than that of the annular recess 98 within which the collar 110*d* is positioned. To the left of the collar 110*d*, is a further reduced diameter portion 110*e*. Plunger 110 terminates on the right in a slightly enlarged diameter portion 110*f*. Portion 110, collar 110*d*, and reduced diameter portion 110*e* defines a peripheral groove 120 on the plunger within which is positioned, O-ring seal 118 having an internal diameter less than that of the plunger portion 110*f* and an outer diameter equal to or slightly greater than the diameter of the annular recess 98 within the receptacle body counterbore 98.

The coil spring 114 has its end opposite shoulder 102 bearing on a radial face of collar 110*d*, forcing the plunger 110 to the left as shown in FIG. 4*a*. This causes the O-ring seal to be compressed between the collar 110*d* and shoulder 100 forming a very effective seal to seal the receptacle cavity bearing the plunger male contact 110*a* and the female contact 106. Further, preferably, the axial bore 82 within the receptacle body 48 is filled with a potting compound or other material 124 to not only seal off the electrical connection between the leads 18 and 20 and their female contact members 104, 106, but also to seal off the chambers defined by counterbores 84 and 86 and the peripheral recesses 96, 98, within which is initially achieved the electrical disconnection between the male contacts integral with the plunger and the female contacts with which they mate. The end face of the plunger opening to the exterior of the receptacle body, as at 110*h* for plunger 110, bears on axial hole as at 126 of relatively shallow depth and is of a configuration corresponding to the rounded tip 42*a* of the plug male prong 42. The same occurs for the other half of the connector assembly. The axial holes closely receive the ends of the prongs during the double disconnect, electrical connection achieved between prongs 40, 42 of plug 38, plungers 108, 110 and the corresponding female contact members 104, 106, respectively.

For the other half of the assembly, an identical assembly of parts are provided to achieve a double break electrical connection between prong 42, plunger 108 and female contact member 104, the action occurring simultaneously and in a corresponding manner to that illustrated in FIGS. 4*a*—4*c* inclusive. To achieve this action, the housing 50 is further provided with an integral locking member or stop indicated generally at 128. Stop 129 comprises an integral depending projection with a tapered face 130, and bears an arcuate recess 132 forming opposed bifurcated fingers 134. The tapered or inclined wall 130 facilitates sliding of the male plug 38 into the position shown in FIGS. 1, 3 and 4*c*, where right angle end face 38*a* of the male plug 38 abuts the rear ends 136*a* of fingers 136 formed by bifurcating the stop member 128. In achieving this action, the male prong is moved in the direction of the arrows, FIGS. 4*a*, 4*b*, causing the rounded tips of the prongs 40, 42, to engage within the shallow recesses within the plungers 108, 110 respectively. This action displaces the plungers rearwardly against the bias of the coil springs moving the O-ring seals away from the shoulders and forcing the male contacts of the plungers to engage the female contact members by projecting within the axial bores provided within the ends thereof. Connection is achieved, while sealing is assured, since the O-rings must move with the plungers due to their being carried within the recess formed by the reduced diameter portion 110*e* of the plunger. A double seal is effected since the O-ring performs the function of the primary seal and the potting compound 124 functions to secondarily seal off the receptacle body 48 at the point where the lead wires 19 and 20 are connected to the female contacts 104, 106 carried by the receptacle.

During disconnect, the opposite sequence occurs, that is, FIG. 4*c* back to FIG. 4*a*. As may be appreciated, there is a double electrical disconnect or break, the first occurring as the male contacts move out of the bores of the female contacts FIG. 4*b*, and the second as the prongs move away from the female contact portions of the plungers. The plunger movement actually follows the movement of the male contacts or prongs of plug 38, insuring initial or early first electrical disconnect in the sealed cavity defined by bores and counterbores and the peripheral recesses within the receptacle body 48, sealed off from the exterior by way of the O-ring seals 116, 118.

It is important that the double break occur during electrical disconnection, and that the initial disconnection be effected in a sealed space achieved by effecting disconnect between the plungers and the female contacts borne by the receptacle body. However, it makes no difference if the plunger carries the female contact and the male contacts are fixed to the plunger body, that is, the opposite to that illustrated in the drawing.

While the invention has been particularly shown and described with reference to a preferred embodiment thereof, it will be understood by those skilled in the art that various changes in form and details may be made therein without departing from the spirit and scope of the invention.

What is claimed is:

1. In an electrified wet pick up vacuum hose assembly for vacuum coupling of a vacuum pick up head to a dirty water accumulation tank for a wet/dry vacuum extraction machine, and wherein the vacuum pick up head carries an electrical motor driven scrubber assembly for scrubbing of the surface being cleaned adjacent the area of dirty water vacuum pick up, said hose assembly being comprised of concentric inner and outer flexible hoses connected at opposite ends to tubular couplings, insulated electrical wires carried by the vacuum hose assembly between the flexible hoses for connecting an electrical source at the water accumulation tank and the hose assembly to the electrical motor at the vacuum head end, the improvement comprising:

a double disconnect electrical connector mounted to the vacuum hose assembly adjacent the vacuum head end thereof, said double disconnect connector including receptacle means bearing axially slidable, spring biased first and second contacts for effecting an initial, first disconnection and means for sealing the area of said initial, first disconnection to the exterior of the hose assembly.

2. The improved electrified wet pick up vacuum hose assembly as claimed in claim 1, wherein the end of said vacuum hose assembly comprises a cylindrical cuff mounted to said tubular coupling, said cylindrical cuff including an elongated pocket, an elongated receptacle body mounted within said pocket and being formed of insulative material, said receptacle body including laterally spaced longitudinally extending bores from one end thereof, said bores being counterbored over a portion of their length and bearing in turn peripheral, circumferential recesses, an elongated cylindrical plunger being slidably mounted within each counterbore, said plunger including a radial collar intermediate of its ends said collar having a diameter on the order of the diameter of the peripheral recess and being positioned therein, a coil spring being mounted within the recess to one side of the collar and abutting the collar at one end and a shoulder formed between the recess and the counterbore at the opposite end thereof, the compression springs acting to normally shift the plungers axially towards one end of the recess, means for supporting an O-ring on said plunger to the opposite side of said collar from said coil spring for sealing off the cavity formed by the recess, a fixed first contact within said bore and having a portion opening to the interior of the cavity and facing the end of said plunger bearing said collar and being engageable therewith to form an initial sealed disconnect first break for an electric circuit through said hose assembly supported electrical leads.

3. The improved electrified wet pick up vacuum hose assembly as claimed in claim 2, further comprising locking means borne by said rigid cuff and wherein said connector assembly further comprises a detachable plug bearing a pair of male contact prongs projecting outwardly therefrom at one end thereof and being connected to electrical wires at their other ends, said plug being detachably coupled to said receptacle and being frictionally held to said receptacle by said locking means which envelope the periphery of the electrical leads coupled to said plug prongs with said locking means abutting a radially enlarged portion of said plug and with said male contact prongs projecting into respective counterbores of said receptacle body, and wherein the ends of said plunger within said counterbore facing said plug bearing axial recesses corresponding in configuration and size to the ends of said male contact prongs borne by said plug such that a two break connection is initially made by first inserting said prongs into said counterbore, causing the tips of said prongs to engage the recess within the ends of said plunger and subsequently said plungers are forced to move axially against the bias of the compression springs to the extent that said first and second contacts engage to complete the electrical circuit between the leads borne by said plug and the leads extending from between the flexible hoses and connected to said first contacts.

* * * * *